US012605035B1

(12) United States Patent
Chen

(10) Patent No.: US 12,605,035 B1
(45) Date of Patent: Apr. 21, 2026

(54) DISH RACK

(71) Applicant: Dongxia Chen, Puning (CN)

(72) Inventor: Dongxia Chen, Puning (CN)

( * ) Notice: Subject to any disclaimer, the term of this patent is extended or adjusted under 35 U.S.C. 154(b) by 0 days.

(21) Appl. No.: 19/360,956

(22) Filed: Oct. 16, 2025

(51) Int. Cl.
*A47L 19/04* (2006.01)

(52) U.S. Cl.
CPC ..... *A47L 19/04* (2013.01)

(58) Field of Classification Search
CPC ..... A47L 19/04; A47L 19/02; A47L 15/502; A47L 15/505; A47J 31/4428
See application file for complete search history.

(56) References Cited

U.S. PATENT DOCUMENTS 2,936,898 A * 5/1960 Miguez ..... A47L 19/04 211/41.3
3,463,343 A * 8/1969 Asenbauer ..... B65D 21/0213 220/532
4,169,638 A * 10/1979 Cirasuolo ..... A47L 19/04 211/41.6
5,083,827 A * 1/1992 Hollenbaugh, Sr. .... B60R 13/01 296/37.16
5,119,943 A * 6/1992 Hoang ..... A47L 19/00 211/168
6,179,134 B1 * 1/2001 Pine ..... A47L 19/04 312/228.1
6,467,622 B1 * 10/2002 Hull ..... B65D 1/36 206/553
6,543,069 B1 * 4/2003 Nelson ..... A47L 19/04 211/41.3
D490,198 S * 5/2004 Jerstroem ..... D32/55
7,325,695 B2 * 2/2008 Yang ..... A47L 19/04 211/41.3
7,344,036 B2 * 3/2008 Jerstroem ..... A47L 19/04 211/41.6
7,464,827 B2 * 12/2008 Meissen ..... B65D 21/086 229/101
7,857,147 B2 * 12/2010 Mulaw ..... A47L 19/04 220/572
8,074,813 B2 * 12/2011 Yang ..... A47L 19/04 211/41.3
8,794,455 B2 * 8/2014 Yang ..... A47L 19/04 211/41.3

(Continued)

FOREIGN PATENT DOCUMENTS

CA 2714776 C * 7/2016 ..... A47L 19/04
TW 201332498 A * 8/2013 ..... A47J 31/44

*Primary Examiner* — Patrick D Hawn
(74) *Attorney, Agent, or Firm* — Bayramoglu Law Offices LLC

(57) ABSTRACT

A dish rack includes a drainage rack and a drip tray, where the drip tray includes a fixed tray and a sliding tray that are connected to each other; a sliding groove is formed in the fixed tray; the sliding tray is slidably connected to the sliding groove; a limit portion is disposed on the sliding groove; when the sliding tray slides to a maximum distance away from the fixed tray, the sliding tray abuts against the limit portion, such that the fixed tray and the sliding tray are combined as a whole; and the fixed tray is provided with the drainage rack, or the sliding tray is provided with the drainage rack, or each of the fixed tray and the sliding tray is provided with the drainage rack. The sliding tray and the fixed tray move relatively to change a size of the drip tray.

11 Claims, 7 Drawing Sheets

(56) References Cited

U.S. PATENT DOCUMENTS

| | | | | |
|---|---|---|---|---|
| 8,925,742 | B1 * | 1/2015 | Chitayat | A47L 19/04 211/41.6 |
| 9,161,677 | B2 * | 10/2015 | Hofpeter | A47L 15/502 |
| 9,427,136 | B2 * | 8/2016 | Kent | A47L 19/04 |
| 10,271,710 | B2 * | 4/2019 | Wegner | A47L 15/506 |
| D882,899 | S * | 4/2020 | Evans | D32/55 |
| D921,318 | S * | 6/2021 | Ling | D32/55 |
| D967,583 | S * | 10/2022 | Zheng | D32/55 |
| D1,008,597 | S * | 12/2023 | Ling | D32/55 |
| D1,030,172 | S * | 6/2024 | Jiang | D32/55 |
| D1,071,444 | S * | 4/2025 | Wen | D32/55 |
| D1,071,447 | S * | 4/2025 | Chen | D32/55 |
| D1,071,449 | S * | 4/2025 | Tang | D32/55 |
| 12,329,347 | B2 * | 6/2025 | Carr | A47L 19/04 |
| 12,471,751 | B1 * | 11/2025 | McKenzie | A47L 19/04 |
| 2005/0040120 | A1 * | 2/2005 | Pine | A47L 19/04 211/41.6 |
| 2006/0243681 | A1 * | 11/2006 | Bastuji | A47L 15/502 211/41.8 |
| 2007/0090063 | A1 * | 4/2007 | Schmidt | A47L 19/04 211/41.3 |
| 2012/0138550 | A1 * | 6/2012 | Wisniewski | A47L 19/04 211/41.3 |
| 2025/0213097 | A1 * | 7/2025 | Renz | A47L 15/502 |

* cited by examiner

DISH RACK

TECHNICAL FIELD

The present disclosure relates to the technical field of dish drainage racks, and in particular to a dish rack.

BACKGROUND

Dish racks are storage racks designed for a kitchen to hold dishes. They are mainly used to store dishes and allow the dishes to drain. Specifically, through a drainage rack, residual water on the dishes is guided to a bottom drip tray, facilitating fast air-drying of the dishes to prevent bacterial growth. Meanwhile, the dish racks can further provide storage for the dishes to save the kitchen space. However, due to a fixed size of the drip tray, the storage space of the existing dish racks cannot be adjusted according to their use. If the storage space of the drainage rack is expanded upward, the dish racks filled with the dishes have a high center of gravity and poor stability, and are likely to be toppled over, posing a significant safety hazard.

SUMMARY

(I) Technical Problem to be Solved

In view of the above shortcomings and deficiencies of the prior art, the present disclosure provides a dish rack, to solve the technical problem of difficult expansion for the storage space of the existing dish rack.

(II) Technical Solutions

To achieve the above objective, the present disclosure provides a dish rack, including a drainage rack and a drip tray, where the drip tray includes a fixed tray and a sliding tray that are connected to each other; a sliding groove is formed in the fixed tray; and the sliding tray is slidably connected to the sliding groove;

a limit portion is disposed on the sliding groove; and when the sliding tray slides to a maximum distance away from the fixed tray, the sliding tray abuts against the limit portion, such that the fixed tray and the sliding tray are combined as a whole; and the fixed tray is provided with the drainage rack, or the sliding tray is provided with the drainage rack, or each of the fixed tray and the sliding tray is provided with the drainage rack.

Optionally, each of the fixed tray and the sliding tray includes a bottom plate and a side plate connected to the bottom plate; and a gap is formed at a first side of each of the fixed tray and the sliding tray; and the gap of the fixed tray and the gap of the sliding tray are opposite to each other and match with each other, such that the fixed tray and the sliding tray are slidably sleeved together;

and the sliding tray can slide to a position under the bottom plate of the fixed tray and partially overlap with the fixed tray.

Optionally, the side plate of the fixed tray extends downward to form a lower extension portion; the sliding groove is formed between the lower extension portion and the bottom plate of the fixed tray; the side plate of the sliding tray is slidably disposed in the sliding groove; and the limit portion is disposed on the lower extension portion, and adjacent to the gap of the fixed tray.

Optionally, a pair of guide rods are disposed on the side plate of the sliding tray, and the guide rods are slidably connected to the fixed tray.

Optionally, the side plate of the fixed tray extends upward to form an upper extension portion; a pair of guide holes are formed in the upper extension portion; and first ends of the pair of guide rods are slidably connected to the pair of guide holes in one-to-one correspondence.

Optionally, second ends of the pair of guide rods are connected through a connecting rod to form a U-shaped frame.

Optionally, the dish rack further includes a drainage barrel, and the drainage barrel is detachably connected to the U-shaped frame.

Optionally, the drainage barrel includes a barrel body, a first hook, and a second hook; the first hook and the second hook are disposed on the barrel body; and the barrel body is disposed on the U-shaped frame through the first hook or the second hook.

Optionally, the bottom plate of each of the fixed tray and the sliding tray is obliquely disposed; and along a sliding direction of the sliding tray away from the fixed tray, a horizontal height of the bottom plate of each of the fixed tray and the sliding tray decreases gradually.

Optionally, a guide plate is disposed on the bottom plate of the sliding tray, and the guide plate is located at a lowest position of the bottom plate of the sliding tray.

Optionally, a plurality of leakage holes are formed in the bottom plate of the fixed tray, and the leakage holes are located at a lowest position of the bottom plate of the fixed tray.

Optionally, a plurality of ridges are disposed on the bottom plate of each of the fixed tray and the sliding tray.

Optionally, a first fixing groove and a second fixing groove are formed in the bottom plate of the fixed tray; the first fixing groove is vertically disposed; the second fixing groove is horizontally disposed; and a group of opposite side edges of the drainage rack are respectively clamped with the first fixing groove and the second fixing groove in one-to-one correspondence.

Optionally, a support leg is disposed at a bottom of each of the fixed tray and the sliding tray.

(III) Beneficial Effects

By pulling or pushing the sliding tray, the sliding tray is driven to move. In this case, the sliding tray and the fixed tray move relatively to change a size of the drip tray, thereby expanding the size of the drip tray to place more dishes. Meanwhile, by adjusting the size of the drip tray, the present disclosure can adapt to different mounting positions, preventing a situation that the drip tray cannot be disposed stably for a size mismatch with the mounting position.

When the sliding tray slides to the maximum distance away from the fixed tray, the sliding tray abuts against the limit portion. In this case, the sliding tray cannot move continuously. Even though the sliding tray moves until a maximum storage space of the drip tray, the fixed tray and the sliding tray are still connected together, and combined as a whole, preventing separation of the sliding tray from the fixed tray. In a usage scenario, when the fixed tray or the sliding tray is held by a user, there is no need to worry about the situation where the fixed tray and the sliding tray are separated to fall off, improving user convenience.

To mount the drainage rack, there are a plurality of implementations: Implementation 1: When the drainage rack is disposed in the fixed tray, the sliding tray located on a lower layer serves as an expandable space, and can be configured to place items other than the dishes, thereby enriching the use scenario of the product. Implementation 2: When the drainage rack is disposed in the sliding tray, the fixed tray as an upper layer may also be configured to place items other than the dishes, thereby enriching the use scenario of the product. Implementation 3: Each of the fixed tray and the sliding tray is provided with the drainage rack, and the sliding tray located on a lower layer serves as an expandable space to increase a storage position for the dishes. A position of the sliding tray can be adjusted according to an actual quantity of the dishes, reducing an occupied space of the drip tray.

REFERENCE NUMERALS

1: drainage rack;
2: fixed tray; 21: sliding groove; 22: limit portion; 23: leakage hole; 24: first fixing groove; and 25: second fixing groove;
3: sliding tray; and 31: guide plate;
4: bottom plate;
5: side plate; 51: lower extension portion; 52: upper extension portion; and 53: guide hole;
61: guide rod; and 62: connecting rod;
7: drainage barrel; 71: barrel body; 72: first hook; and 73: second hook;
8: ridge; and
9: support leg.

DETAILED DESCRIPTION OF THE EMBODIMENTS

To facilitate a better understanding of the present disclosure, the present disclosure is described in detail below with reference to the accompanying drawings and specific embodiments. The terms such as "upper" and "lower" mentioned herein are based on the orientations shown in FIG. 1.

Although the accompanying drawings show exemplary embodiments of the present disclosure, it should be understood that the present disclosure may be implemented in various forms and should not be limited to the embodiments set forth herein. The embodiments are provided for a more thorough understanding of the present disclosure, so as to make the scope of the present disclosure be fully conveyed to those skilled in the art.

The present disclosure provides a dish rack. The present disclosure is intended to adjust a structure of a drip tray of the dish rack, such that the drip tray has a space expansion capability.

Figure 1:
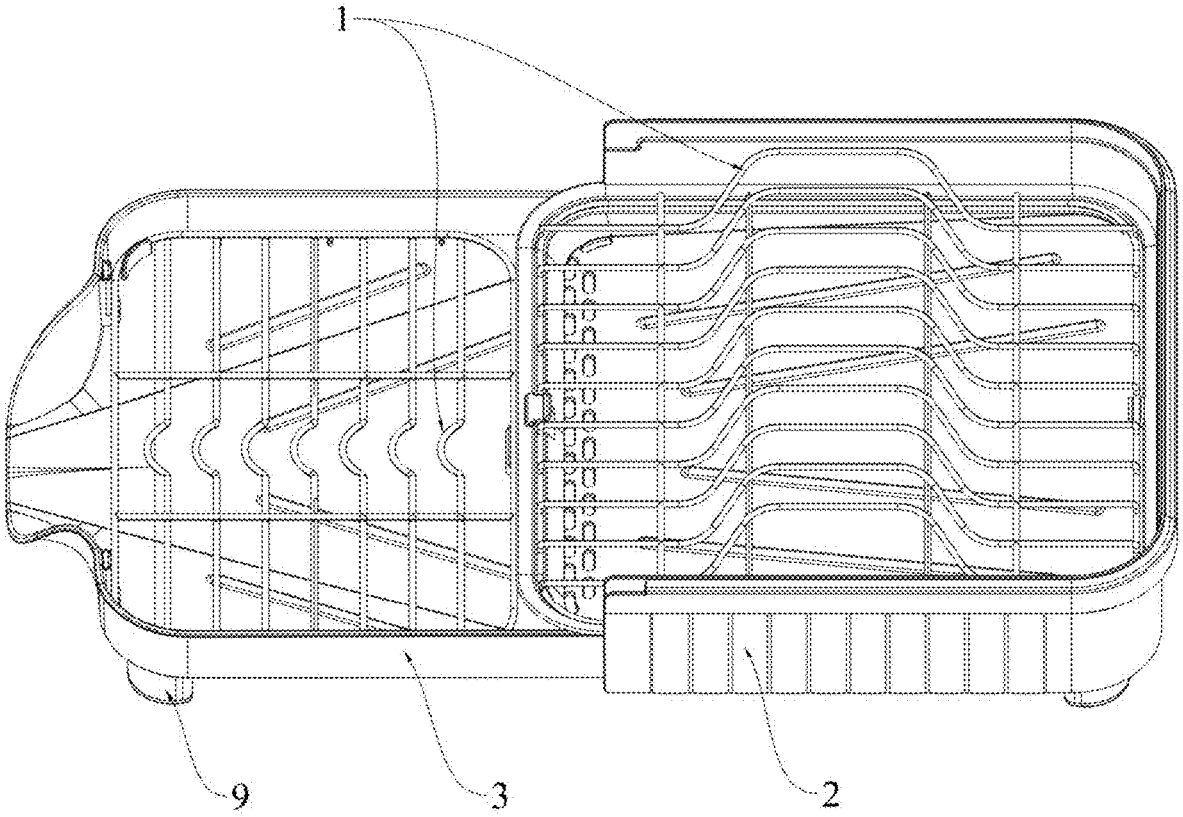
FIG. 1 is a schematic structural view of a dish rack according to the present disclosure.

As shown in FIG. 1, the dish rack includes drainage rack 1 and a drip tray. The drainage rack 1 is typically woven from a metal wire, and configured to place dishes such as bowls and plates. The drip tray includes fixed tray 2 and sliding tray 3 that are connected to each other. Sliding groove 21 is formed in the fixed tray 2. The sliding tray 3 is slidably connected to the sliding groove 21. The sliding tray 3 is slidably disposed under the fixed tray 2. The fixed tray 2 and the sliding tray 3 are layered vertically. By pulling or pushing the sliding tray 3, the sliding tray 3 is driven to move. In this case, the sliding tray 3 and the fixed tray 2 move relatively to change a size of the drip tray, thereby expanding the size of the drip tray to place more dishes. Meanwhile, by adjusting the size of the drip tray, the present disclosure can adapt to different mounting positions, preventing a situation that the drip tray cannot be disposed stably for a size mismatch with the mounting position.

Figure 2:
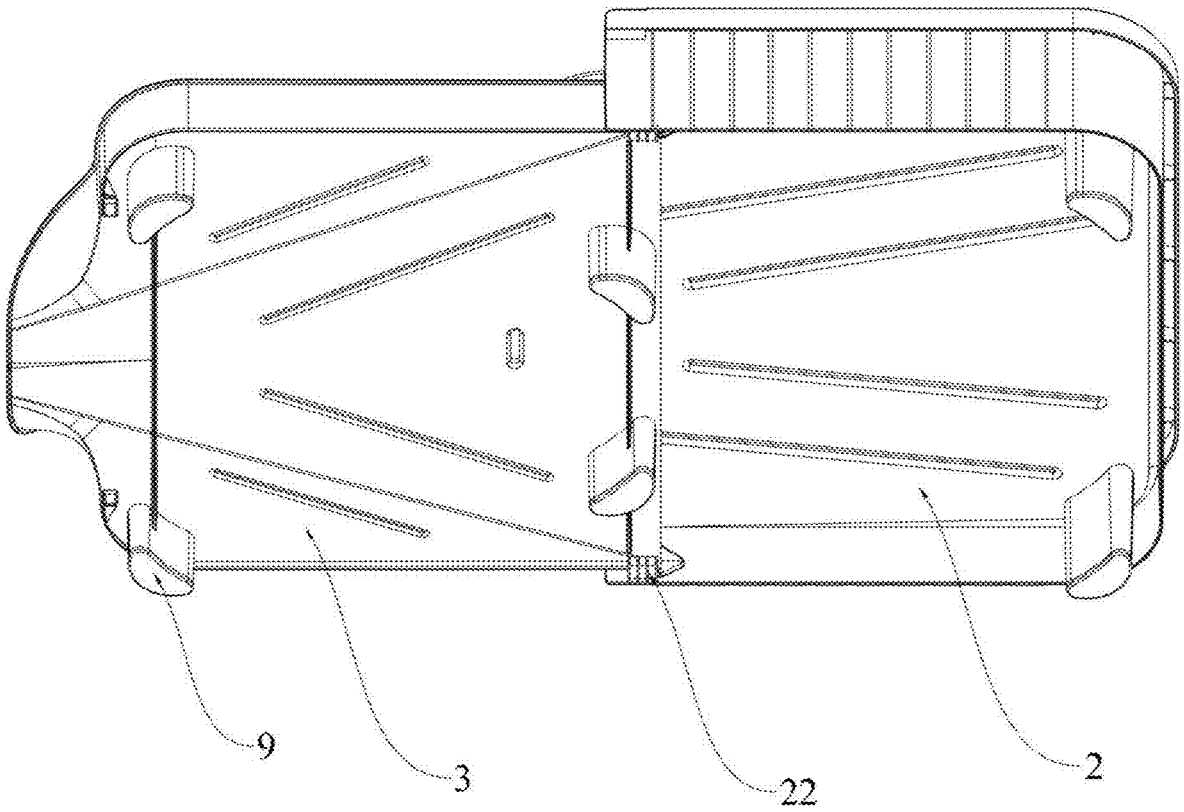
FIG. 2 is a schematic structural view of a bottom of a dish rack according to the present disclosure.

As shown in FIG. 2, limit portion 22 is disposed on the sliding groove 21. The limit portion 22 is a groove structure, and is connected under the sliding groove 21. When the sliding tray 3 slides to a maximum distance away from the fixed tray 2, the sliding tray 3 abuts against the limit portion 22. In this case, the sliding tray 3 cannot move continuously. Even though the sliding tray 3 moves until a maximum storage space of the drip tray, the fixed tray 2 and the sliding tray 3 are still connected together, and combined as a whole, preventing separation of the sliding tray 3 from the fixed tray 2. In a usage scenario, when the fixed tray 2 or the sliding tray 3 is held by a user, there is no need to worry about the situation where the fixed tray 2 and the sliding tray 3 are separated to fall off, improving user convenience.

To mount the drainage rack 1, there are a plurality of implementations:

Implementation 1: When the drainage rack 1 is disposed in the fixed tray 2, the sliding tray 3 located on a lower layer serves as an expandable space, and can be configured to place items other than the dishes, thereby enriching the use scenario of the product.

Implementation 2: When the drainage rack 1 is disposed in the sliding tray 3, the fixed tray 2 as an upper layer may also be configured to place items other than the dishes, thereby enriching the use scenario of the product.

Implementation 3: Each of the fixed tray 2 and the sliding tray 3 is provided with the drainage rack 1, and the sliding tray 3 located on a lower layer serves as an expandable space to increase a storage position for the dishes. A position of the sliding tray 3 can be adjusted according to an actual quantity of the dishes, reducing an occupied space of the drip tray.

Figure 3:
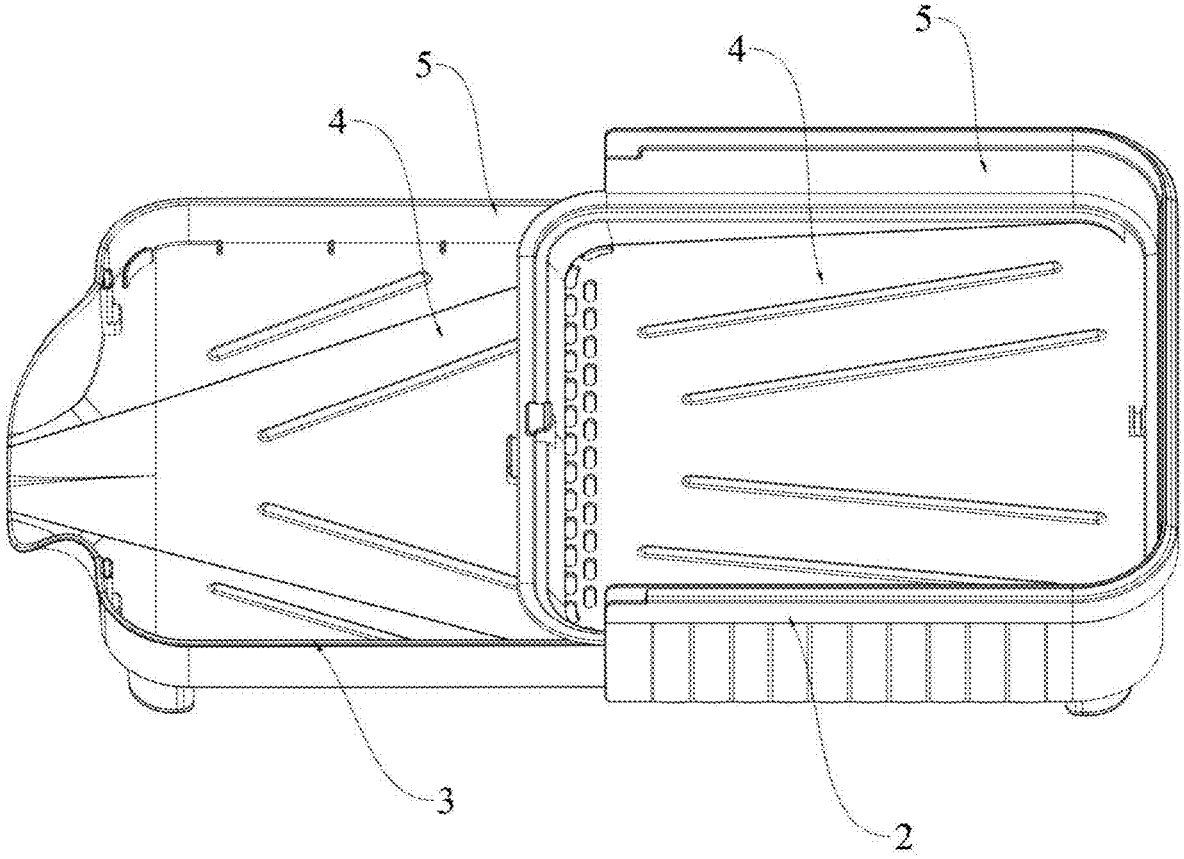
FIG. 3 is a schematic structural view of a bottom plate and a side plate of a dish rack according to the present disclosure.

As shown in FIG. 3, each of the fixed tray 2 and the sliding tray 3 includes bottom plate 4 and side plate 5 connected to the bottom plate 4. The side plate 5 surrounds the bottom plate 4. A first side of each of the fixed tray 2 and the sliding tray 3 is provided with an abutment gap, rather than the side plate 5. The gap of the fixed tray 2 and the gap of the sliding tray 3 are opposite to each other and match with each other, such that the fixed tray 2 and the sliding tray 3 are slidably sleeved together to form a telescopic drip tray structure. When the sliding tray 3 slides, the sliding tray 3 can slide to a position under the bottom plate 4 of the fixed tray 2, and partially overlap with the fixed tray 2, which reduces a length of the drip tray without increasing a height of the drip tray. When the space of the drip tray is to be expanded, the sliding tray 3 is drawn out.

Figure 4:
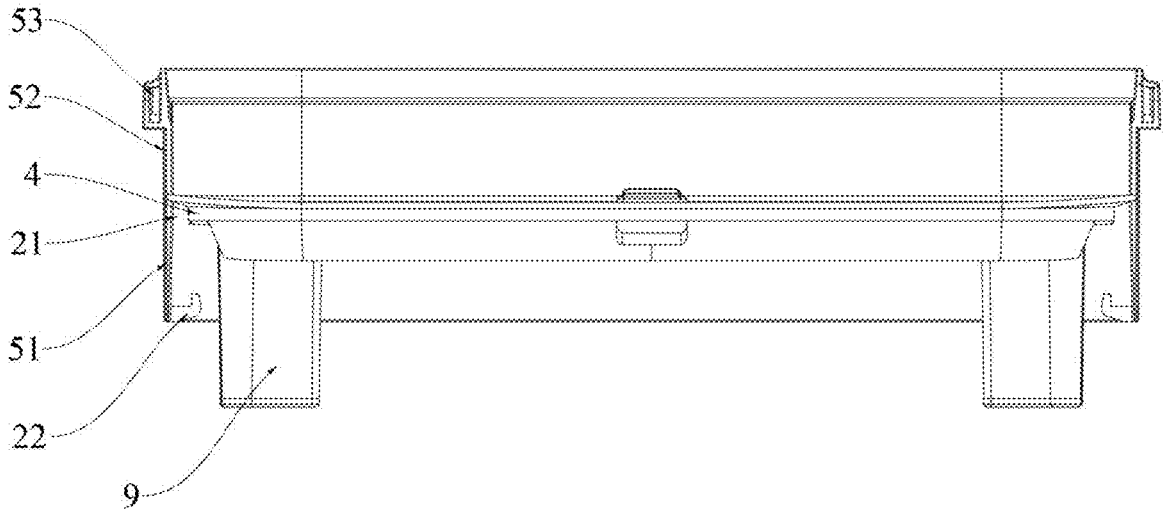
FIG. 4 is a schematic structural view of a fixed tray of a dish rack according to the present disclosure.

As shown in FIG. 4, the side plate 5 of the fixed tray 2 extends downward to form lower extension portion 51. The sliding groove 21 is formed between the lower extension portion 51 and the bottom plate 4 of the fixed tray 2. The side plate 5 of the sliding tray 3 is slidably disposed in the sliding groove 21. The limit portion 22 is disposed on the lower extension portion 51, and adjacent to the gap of the fixed tray 2, ensuring that the sliding tray 3 has a maximum sliding distance. The limit portion 22 is the groove structure. The groove of the limit portion 22 and the sliding groove 21 are opposite to each other, forming a vertically opposite groove structure. The side plate 5 of the sliding tray 3 is disposed between the limit portion 22 and the sliding groove 21. An end of the side plate 5 of the sliding tray 3 located at the gap is provided with a hook. When the hook abuts against the limit portion 22, the sliding tray 3 slides to the maximum distance away from the fixed tray 2.

Figure 5:
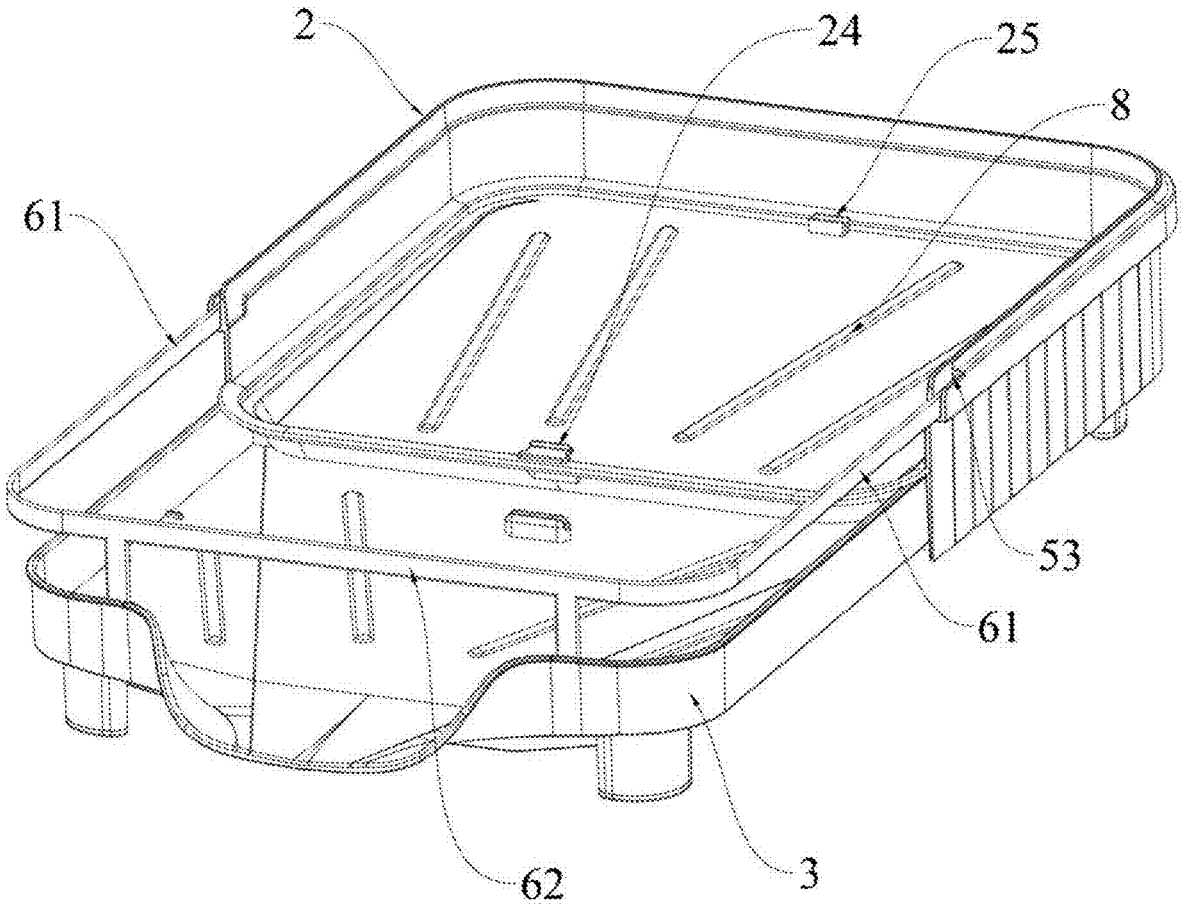
FIG. 5 is a schematic structural view of a guide rod of a dish rack according to the present disclosure.

As shown in FIG. 5, a pair of guide rods 61 are respectively disposed on a group of opposite side plates 5 of the sliding tray 3. The guide rod 61 is parallel to the corresponding side plate 5. The guide rod 61 is slidably connected to the fixed tray 2, such that the sliding tray 3 can only move along an axial direction of the guide rod 61. The guide rod 61 serves as an auxiliary guiding effect, preventing clamping stagnation due to an overlarge included angle between the side plate 5 and an inner wall of the sliding groove 21 when the sliding tray 3 moves. Specifically, an insertion rod is connected to the guide rod 61. A plurality of insertion holes are formed at an inner side of the side plate 5 of the sliding tray 3. By inserting the insertion rod into the insertion hole, the guide rod 61 can be fixed on the side plate 5 of the sliding tray 3.

As shown in FIG. 4 and FIG. 5, the side plate 5 of the fixed tray 2 extends upward from the bottom plate 4 to form upper extension portion 52. A pair of guide holes 53 are formed at an outer side of the upper extension portion 52. First ends of the pair of guide rods 61 are slidably connected to the pair of guide holes 53 in one-to-one correspondence. The guide rod 61 is a flat guide bar. The guide hole 53 matches with the guide rod 61 to increase stability. A top of the side plate 5 of the fixed tray 2 is rolled down to form a downward-opened guide groove. The guide rod 61 is disposed in the guide groove. The limiting bottom plate 4 is disposed at a notch of the guide groove to support the guide rod 61 upward.

As shown in FIG. 5, second ends of the pair of guide rods 61 are connected through connecting rod 62 to form a U-shaped frame, increasing stability of the guide rods 61. The insertion rod is disposed on the connecting rod 62, fixing the U-shaped frame on the side plate 5 of the sliding tray 3. The U-shaped frame surrounds the sliding tray 3 to form a fence structure. This increases the height of the side plate 5 of the sliding tray 3, without affecting the movement of the sliding tray 3 to slide to the position under the fixed tray 2.

Figure 6:
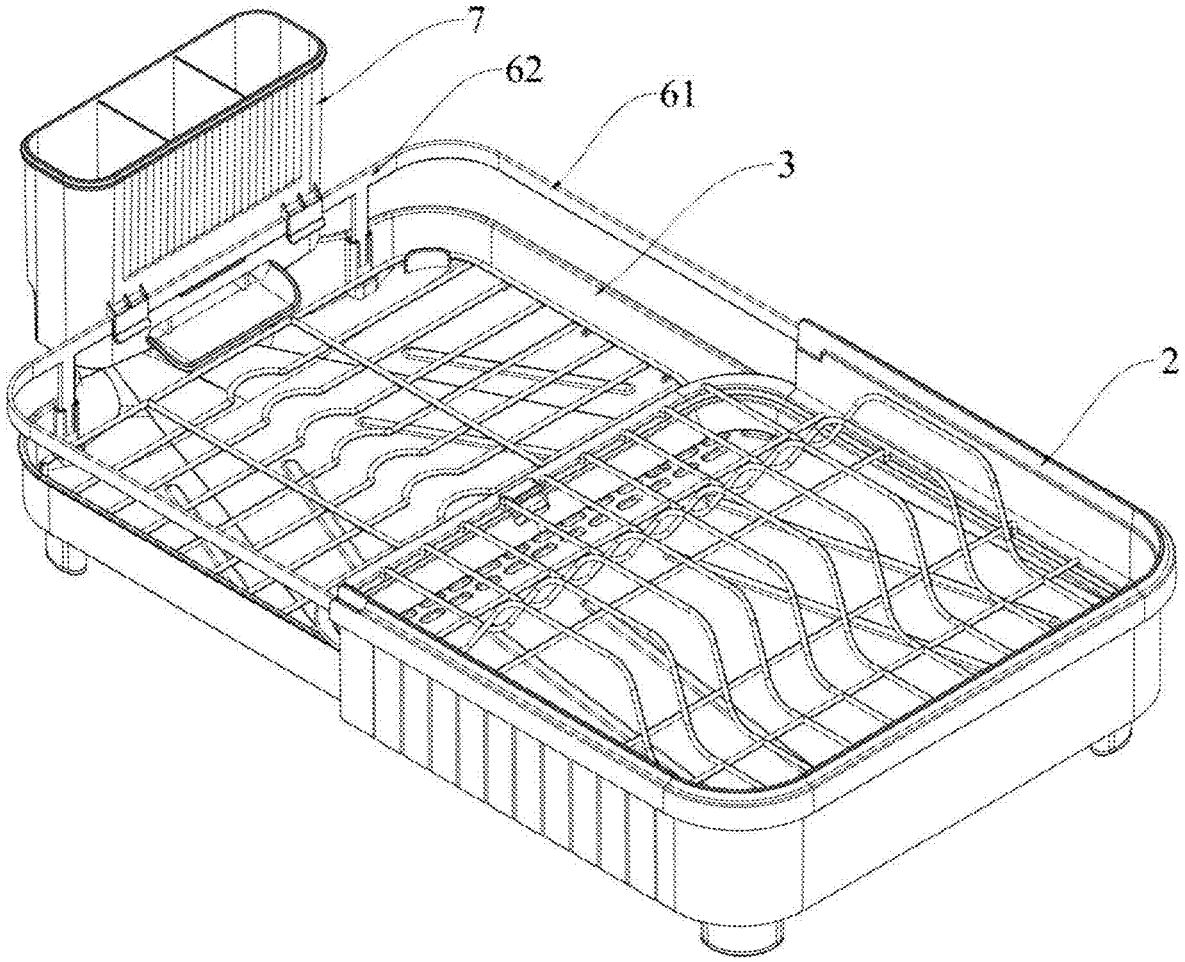
FIG. 6 is a schematic mounting view of a drainage barrel of a dish rack according to the present disclosure.
Figure 7:
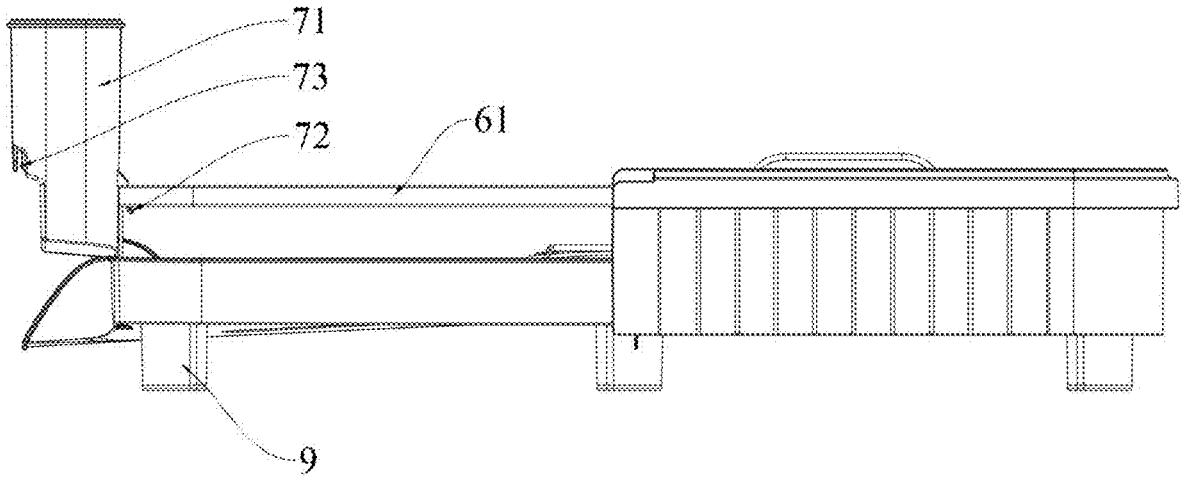
FIG. 7 is a schematic structural view of a drainage barrel of a dish rack according to the present disclosure.

As shown in FIG. 6 and FIG. 7, the dish rack further includes drainage barrel 7. The drainage barrel 7 is detachably connected to the U-shaped frame, and configured to place elongated dishes such as chopsticks and spoons. The drainage barrel 7 includes barrel body 71, first hook 72, and second hook 73. The first hook 72 and the second hook 73 are disposed on the barrel body 71, and respectively located on a group of opposite sides of the barrel body 71. The barrel body 71 can be suspended at any position of the U-shaped frame through the first hook 72 or the second hook 73. Selecting different hooks can change a placement direction of the barrel body 71. A plurality of separation plates are disposed in the barrel body 71, so as to separate a space in the barrel body 71 to facilitate classification of items. A bottom of the barrel body 71 is tapered and is provided with a guide hole. A guiding groove extending out of the barrel body 71 is connected to the guide hole. When the first hook 72 is connected to the U-shaped frame, the guide groove is toward the sliding tray 3, guiding water to the sliding tray 3 through the guide groove. Then, the water is discharged by the sliding tray 3. When the second hook 73 is connected to the U-shaped frame, namely dishes are placed in the sliding tray 3, the guide groove is outward from the sliding tray 3, so as not to guide the water to the dishes to cause secondary pollution.

Figure 8:
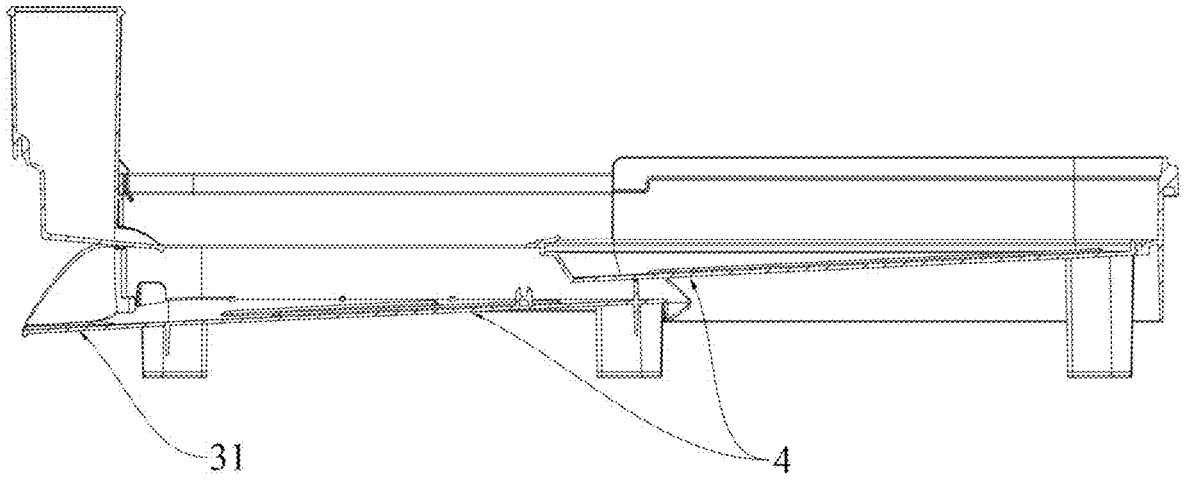
FIG. 8 is a schematic structural view of a bottom plate of a dish rack according to the present disclosure.

As shown in FIG. 8, the bottom plate 4 of each of the fixed tray 2 and the sliding tray 3 is obliquely disposed. Along a sliding direction of the sliding tray 3 away from the fixed tray 2, a horizontal height of the bottom plate 4 of each of the fixed tray 2 and the sliding tray 3 decreases gradually, such that water dripping from the dishes flows to the sliding tray 3 along an oblique surface of the bottom plate 4 of the fixed tray 2, and is gathered to a lowest position of the bottom plate 4 of the sliding tray 3. Guide plate 31 is disposed at the lowest position of the bottom plate 4 of the sliding tray 3, guiding the water out of the sliding tray 3.

Figure 9:
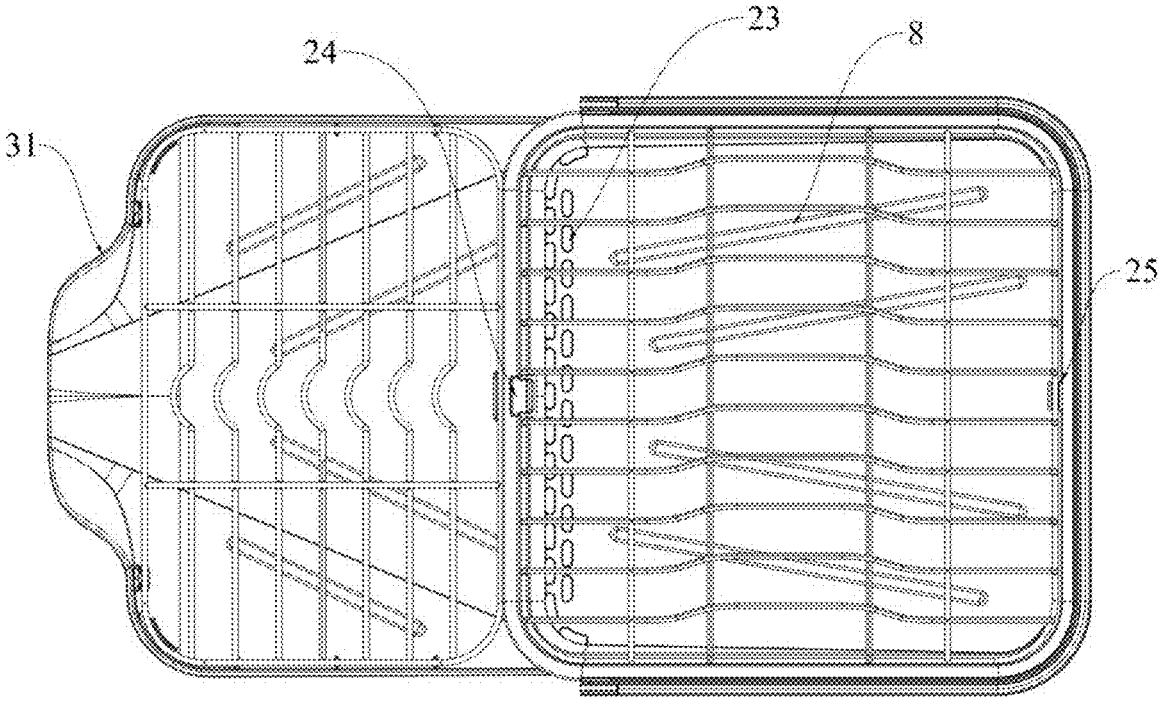
FIG. 9 is a schematic mounting view of a drainage rack of a dish rack according to the present disclosure.

As shown in FIG. 9, a plurality of leakage holes 23 are formed in the bottom plate 4 of the fixed tray 2. The leakage holes 23 are located at a lowest position of the bottom plate 4 of the fixed tray 2. Moreover, when the sliding tray 3 moves to an extreme position away from the fixed tray 2, the leakage holes 23 are still located above the sliding tray 3, and water drips to the sliding tray 3 through the leakage holes 23.

As shown in FIG. 9, a plurality of ridges 8 are disposed on the bottom plate 4 of each of the fixed tray 2 and the sliding tray 3, and configured to guide water on the bottom plate 4 quickly to a low position of the bottom plate 4

As shown in FIG. 5 and FIG. 9, first fixing groove 24 and second fixing groove 25 are formed in the bottom plate 4 of the fixed tray 2. The first fixing groove 24 is vertically disposed. The second fixing groove 25 is horizontally disposed. A group of opposite side edges of the drainage rack 1 are respectively clamped with the first fixing groove 24 and the second fixing groove 25 in one-to-one correspondence. In mounting, one side of the drainage rack 1 is clamped into the second fixing groove 25 first. The drainage rack 1 is rotated downward, until the other side of the drainage rack 1 is clamped into the first fixing groove 24. The drainage rack 1 is disposed on the sliding tray 3 through a plurality of vertically disposed fixing grooves.

As shown in FIG. 1 to FIG. 8, a support leg 9 is disposed at a bottom of each of the fixed tray 2 and the sliding tray 3. Suspending the fixed tray 2 and the sliding tray 3 prevents water accumulation between the drip tray and the countertop. Non-slip rubber is disposed at a bottom of the support leg 9 to improve the stability.

It should be understood that in the description of the present disclosure, terms such as "first" and "second" are used merely for a descriptive purpose, and should not be construed as indicating or implying relative importance, or implicitly indicating a quantity of indicated technical features. Thus, features defined with "first" and "second" may explicitly or implicitly include one or more of the features. In the description of the present disclosure, "a plurality of" means two or more, unless otherwise specifically defined.

In the present disclosure, unless otherwise clearly specified, the terms "installation", "interconnection", "connection" and "fixation" etc. are intended to be understood in a broad sense. For example, the "connection" may be a fixed connection, removable connection or integral connection; may be a mechanical connection or electrical connection; may be a direct connection or indirect connection using a medium; and may be a communication or interaction between two elements. Those of ordinary skill in the art may understand specific meanings of the above terms in the present disclosure based on a specific situation.

In the present disclosure, unless otherwise explicitly specified, when it is described that a first feature is "above" or "below" a second feature, it indicates that the first and second features are in direct contact or the first and second features are in indirect contact through an intermediate feature. In addition, when it is described that the first feature is "over", "above" and "on" the second feature, it indicates that the first feature is directly or obliquely above the second feature, or simply indicates that an altitude of the first feature is higher than that of the second feature. When it is described that a first feature is "under", "below" or "beneath" a second feature, it indicates that the first feature is directly or obliquely under the second feature or simply indicates that the first feature is lower than the second feature.

In the description of this specification, the description with reference to the terms such as "one embodiment", "some embodiments", "example", "specific example" or "some examples" means that specific features, structures, materials or characteristics described in connection with the embodiment or example are included in at least one embodiment or example of the present disclosure. In this specification, the schematic expression of the above terms is not necessarily directed to the same embodiment or example. Furthermore, the specific features, structures, materials, or characteristics described may be combined in a suitable manner in any one or more of embodiments or examples. In addition, those skilled in the art may combine different embodiments or examples described in this specification and characteristics of the different embodiments or examples without mutual contradiction.

Although the embodiments of the present disclosure have been illustrated and described above, it will be appreciated that the above embodiments are illustrative and should not be construed as limiting the present disclosure. Changes, modifications, substitutions, and variations can be made to the above embodiments by a person of ordinary skill in the art within the scope of the present disclosure.

What is claimed is:

1. A dish rack, comprising: a drainage rack and a drip tray, wherein the drip tray comprises a fixed tray and a sliding tray, wherein the fixed tray and the sliding tray are connected to each other; a sliding groove is formed in the fixed tray; and the sliding tray is slidably connected to the sliding groove;

a limit portion is disposed on the sliding groove; and when the sliding tray slides to a maximum distance away from the fixed tray, the sliding tray abuts against the limit portion, such that the fixed tray and the sliding tray are combined as a whole; and the fixed tray is provided with the drainage rack, or the sliding tray is provided with the drainage rack, or each of the fixed tray and the sliding tray is provided with the drainage rack;

wherein each of the fixed tray and the sliding tray comprises a bottom plate and a side plate connected to the bottom plate; and a gap is formed at a side of each of the fixed tray and the sliding tray; and the gap of the fixed tray and the gap of the sliding tray are opposite to each other and are configured to interconnect with each other, such that the fixed tray and the sliding tray are slidably sleeved together; and the sliding tray is configured to slide to a position under the bottom plate of the fixed tray and partially overlaps with the fixed tray;

wherein a pair of guide rods are disposed on the side plate of the sliding tray, and the pair of guide rods are slidably connected to the fixed tray;

wherein the side plate of the fixed tray extends upward to form an upper extension portion; a pair of guide holes are formed in the upper extension portion; and first ends of the pair of guide rods are slidably connected to the pair of guide holes in one-to-one correspondence.

2. The dish rack according to claim 1, wherein the side plate of the fixed tray extends downward to form a lower extension portion; the sliding groove is formed between the lower extension portion and the bottom plate of the fixed tray; the side plate of the sliding tray is slidably disposed in the sliding groove; and the limit portion is disposed on the lower extension portion, and adjacent to the gap of the fixed tray.

3. The dish rack according to claim 1, wherein second ends of the pair of guide rods are connected through a connecting rod to form a U-shaped frame.

4. The dish rack according to claim 3, further comprising a drainage barrel, wherein the drainage barrel is detachably connected to the U-shaped frame.

5. The dish rack according to claim 4, wherein the drainage barrel comprises a barrel body, a first hook, and a second hook; the first hook and the second hook are disposed on the barrel body; and the barrel body is disposed on the U-shaped frame through the first hook or the second hook.

6. The dish rack according to claim 1, wherein the bottom plate of each of the fixed tray and the sliding tray is obliquely disposed; and along a sliding direction of the sliding tray away from the fixed tray, a horizontal height of the bottom plate of each of the fixed tray and the sliding tray gradually decreases.

7. The dish rack according to claim 6, wherein a guide plate is disposed on the bottom plate of the sliding tray, and the guide plate is located at a lowest position of the bottom plate of the sliding tray.

8. The dish rack according to claim 6, wherein a plurality of leakage holes are formed in the bottom plate of the fixed tray, and the plurality of leakage holes are located at a lowest position of the bottom plate of the fixed tray.

9. The dish rack according to claim 1, wherein a plurality of ridges are disposed on the bottom plate of each of the fixed tray and the sliding tray.

10. The dish rack according to claim 1, wherein a support leg is disposed at a bottom of each of the fixed tray and the sliding tray.

11. A dish rack, comprising: a drainage rack and a drip tray, wherein the drip tray comprises a fixed tray and a sliding tray, wherein the fixed tray and the sliding tray are connected to each other; a sliding groove is formed in the fixed tray; and the sliding tray is slidably connected to the sliding groove;

a limit portion is disposed on the sliding groove; and when the sliding tray slides to a maximum distance away from the fixed tray, the sliding tray abuts against the limit portion, such that the fixed tray and the sliding tray are combined as a whole; and the fixed tray is provided with the drainage rack, or the sliding tray is provided with the drainage rack, or each of the fixed tray and the sliding tray is provided with the drainage rack;

wherein each of the fixed tray and the sliding tray comprises a bottom plate and a side plate connected to the bottom plate; and a gap is formed at a side of each of the fixed tray and the sliding tray; and the gap of the fixed tray and the gap of the sliding tray are opposite to each other and are configured to interconnect with each other, such that the fixed tray and the sliding tray are slidably sleeved together; and the sliding tray is configured to slide to a position under the bottom plate of the fixed tray and partially overlaps with the fixed tray;

wherein a first fixing groove and a second fixing groove are formed in the bottom plate of the fixed tray; the first fixing groove is vertically disposed; the second fixing groove is horizontally disposed; and a group of opposite side edges of the drainage rack are respectively clamped with the first fixing groove and the second fixing groove in one-to-one correspondence.

* * * * *